United States Patent [19]

Acord

[11] 3,941,522

[45] Mar. 2, 1976

[54] MODIFIED ROTARY COMPRESSOR YIELDING SINUSOIDAL PRESSURE WAVE OUTPUTS

[75] Inventor: Timothy T. Acord, Alexandria, Va.

[73] Assignee: The United States of America as represented by the Secretary of the Army, Washington, D.C.

[22] Filed: Sept. 13, 1974

[21] Appl. No.: 505,889

[52] U.S. Cl. ..... 418/61 A; 418/183

[51] Int. Cl.[2] ..... F04C 1/02

[58] Field of Search..... 418/61 A, 61 B, 183; 62/6

[56] References Cited

UNITED STATES PATENTS 1,123,977 1/1915 Baker et al. ..... 418/183

1,949,723 3/1934 Kotelevtseff..... 418/183 X

*Primary Examiner*—C. J. Husar

*Assistant Examiner*—Leonard Smith

*Attorney, Agent, or Firm*—Nathan Edelberg; Robert P. Gibson; Milton W. Lee

[57] ABSTRACT

A rotary compressor in which a slice is cut back under one rotor flank and a continuous groove is cut in the rotor housing cover adjacent the slice and intersecting it. The two adjacent rotor flanks can be ported to prevent pressure buildup therein. This arrangement permits the volume under the modified rotor flank to be in constant communication with the compressor output and produce a true sinusoidally varying pressure output.

6 Claims, 3 Drawing Figures

MODIFIED ROTARY COMPRESSOR YIELDING SINUSOIDAL PRESSURE WAVE OUTPUTS

The invention described herein may be manufactured, used, and licensed by or for the Government for governmental purposes without the payment to me of any royalty thereon.

BACKGROUND OF THE INVENTION

The invention relates to the field of rotary compressors. In particular it encompasses a modification to such a compressor of the type particularly useful in the area of cryogenic coolers, such as the one found in U.S. Pat. No. 3,853,437 which is incorporated by reference, which, for maximum efficiency, requires a square or sinusoidal pressure wave.

The standard piston-type compressor, while providing a sinusoidal output pressure, has inherent limitations to efficiency because a rotary-to-linear motion conversion is necessary. The rotary compressor concept eliminates the necessity for such conversion. However, the porting and sealing techniques applied to rotary compressors of the prior art do not yield a true sinusoidal pressure wave. The novel modifications to the rotary compressor hereinafter described do yield the desired sinusoidal pressure output.

SUMMARY

The technique of the disclosed invention involves modifying the rotor by the removal of a slice of material in the region of one rotor flank adjacent a compressor housing side cover and providing a passageway-forming groove in this side cover, with the groove in communication with a pressure outlet port. The modified rotor flank compressor volume, then, is always in communication with the groove and the outlet. Consequently, the pressure wave seen at the outlet port is a sinusoidal pressure variation. The configuration of this side cover groove is determined by the inner envelope of the particular rotor; the groove always being located within this boundary. The width and location of the groove are also governed by the dimensions of the slice of material removed from the rotor.

The compressor geometry can be determined in the following manner. By rotating the rotor of the configuration to be used in the mathematically appropriate manner, an inner and outer envelope are generated. The outer envelope is the housing that was desired for use with this rotor and the inner envelope yields the boundary condition for the side surface groove to be used in the presently disclosed device.

Of course, the chamber configuration could be first determined, and the rotor configuration thereby fixed. The inner envelope of the rotor would still determine the limit of the groove circumference to be used. The advantages of this compressor over prior art piston-type or rotary compressors include the production of a true sinusoidal pressure output with the absence of a rotary-to-linear conversion with an attendant high energy conversion efficiency.

By way of example, the configuration disclosed utilizes the well-known two lobe housing and three flank rotor combination. Three revolutions of the drive shaft would yield one revolution of the rotor resulting in two maxima and minima or two pressure pulses. In general, however, the rotary compressor can take on any one of a variety of compressor housing and rotor configurations derived from the family of trochoidal curves; particularly the peritrochoid, epitrochoid and hypotrochoid. More specifically, the combinations of housings generated by a peritrochoid, epitrochoid or hypotrochoid with the respective inner envelopes of each as the rotor generating function, could be utilized.

The driving means, including the rotor internal gear, fixed eternal gear and the relation between eccentricity and the drive shaft for rotary machines of the type disclosed, are well-known in the art and the description thereof is not necessary here for a complete understanding of this invention. See, for a description of drive means, the book by Kenichi Yamamoto entitled Rotary Engine, published by Toyo Kogyo Co., Ltd.

The only limitation to the possible configurations employable in the present invention is that if sealing means are required between chamber regions, the configuration should be of the form in which these interchamber seals are carried at the rotor apices and not fixed at the chamber housing walls.

DESCRIPTION OF THE PREFERRED EMBODIMENT

Figure 1:
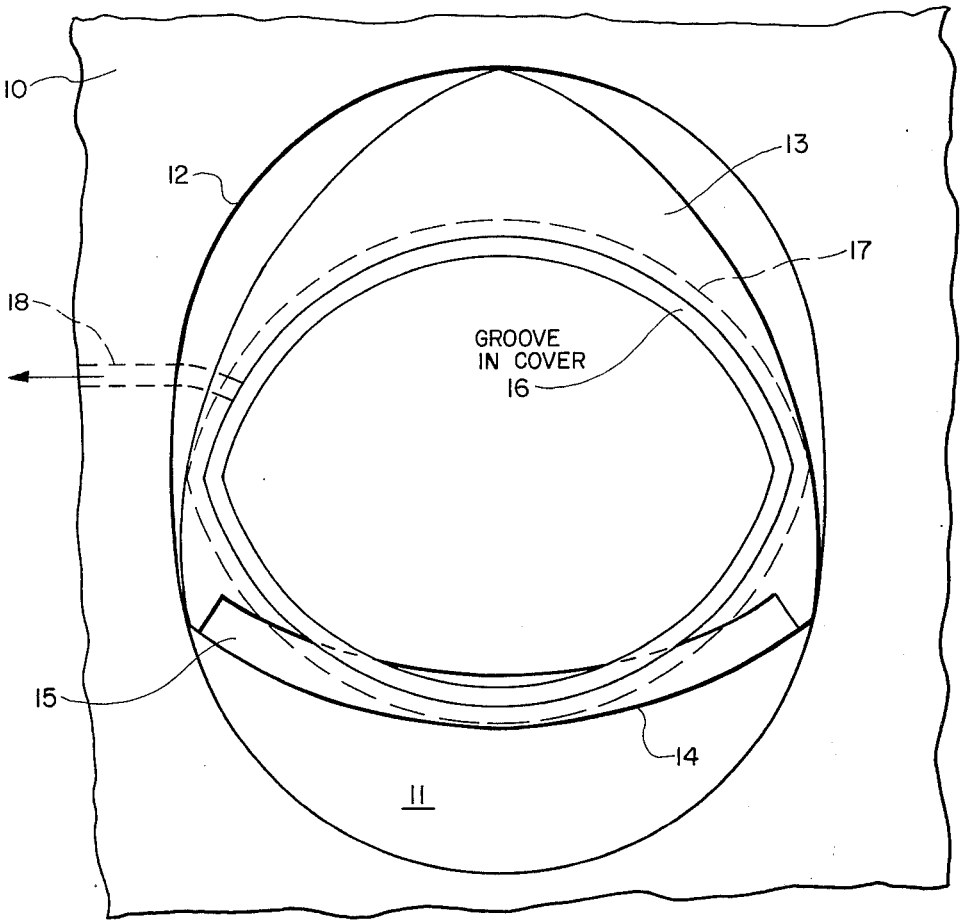
FIG. 1 is a plan view showing the rotor and chamber geometry of a rotary compressor embodying the invention.

Referring to FIG. 1, we see the arrangement of components of the rotary compressor, including the modification of the disclosed invention.

The rotary compressor includes a housing 10, in which is formed the two lobe chamber 11 having the configuration shown by the outermost closed curve 12. As described above, this curve is the outer envelope of the three flank rotor 13 associated therewith and which rotates therein in the known manner. The rotor flank 14 modified according to the present invention shows a slice 15 removed from that portion of the rotor. Since a side seal (not shown here) is normally placed on the rotor side surfaces, the slice 15 removed from the rotor side along the flank 14 would normally entail the removal of a portion of the seal along with a portion of the rotor material. It should also be recognized that, under certain circumstances, it might only be necessary to slice a depth which would remove rotor seal material without cutting into the rotor material itself to produce the desired slice along the modified flank.

The groove 16 in the side cover of the compressor, located just inside the dashed line 17 which is the inner envelope generated by the rotor 13, is shown intersecting a region of the slice 15. At the position shown, the region of intersection is about a maximum. As can be readily seen, the rotation of the rotor 13 in the chamber 11 causes a varying degree of intersection between the groove 16 and the slice 15. It must be made clear that all that is necessary for the present invention is that there be at least a point of intersection at all times as the rotor turns.

An outlet port 18, positioned at any convenient location between the groove 16 and any associated output location, provides an outlet for the sinusoidal pressure waves generated by the operation of this device.

Figure 2:
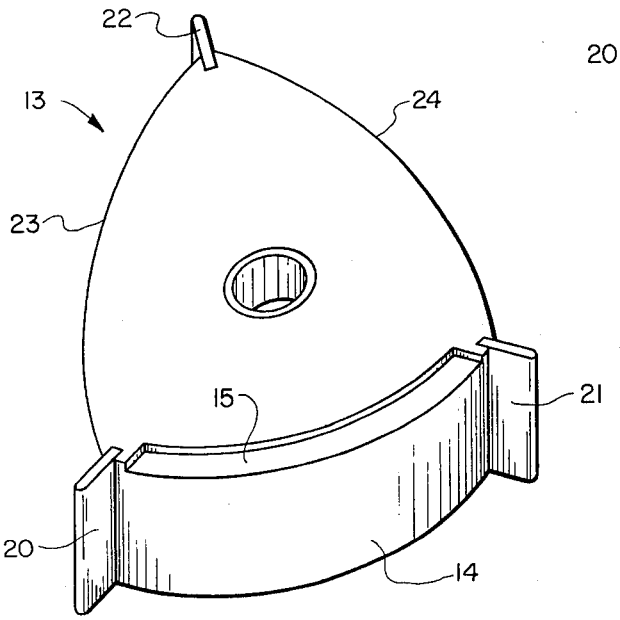
FIG. 2 is an isometric view of the rotor modified according to the invention.
Figure 3:
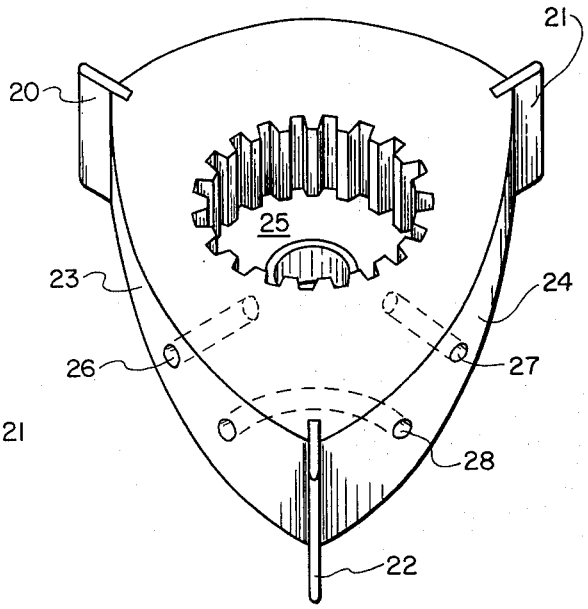
FIG. 3 is an isometric view of the reverse side of the rotor.

In FIG. 2 can be seen an isometric view of the rotor 13. The slice 15 is shown in the flank 14 of the rotor.

Seals 20, 21 and 22 isolate the chamber formed under the flank 14 from the chambers under flanks 23 and 24.

Additional modification is made to the rotor in order to keep the power consumption to a minimum. While the net volume under all three flanks is a constant, the net volume under the two unused flanks 23 and 24 is not. Therefore, work would be required to compress the gas in these regions during the operation of the device. To eliminate this unnecessary work, the unused flanks 23 and 24 are shorted to the crankcase region 25 of the device by passage means 26 and 27 or to some other common volume. However, to minimize gas flow through the crankcase 25, the unused flanks 23 and 24 may also be shorted directly to each other by passage 28. Alternatively, the seal 22 could be modified to short the regions between flanks 23 and 24.

While only one embodiment of the contemplated invention has been described, it is to be understood that many variations, substitutions and alterations may be made while remaining within the spirit and scope of the invention which is limited only by the following claims.

I claim:

1. In a rotary compressor device in which substantially trochoidal curves form the inner surface of the working chambers and the configuration of the internally placed rotary piston of said device and wherein side surfaces close the device to complete the working chambers, the improvement comprising:

a volume formed along a flank of said rotary piston in communication with the compression volume under said flank and adjacent a side surface;

passageway means associated with said side surface for constantly communicating with said volume as said rotary piston revolves; and porting means communicating with said passageway means for providing an outlet for sinusoidally varying pressure generated by said device.

2. The device according to claim 1 wherein the trochoidal curves are selected from the group of curves consisting of the peritrochoid, epitrochoid, and hypotrochoid.

3. The device according to claim 2 wherein the passageway means are within a boundary prescribed by the inner envelope of the rotor revolving according to the trochoidal curve utilized.

4. The device according to claim 3 wherein means for shorting the regions under the unused rotor flanks to a common volume are provided to reduce power consumption by the device.

5. The device according to claim 4 wherein said common volume comprises the crankcase region of the device and wherein the shorting means comprise passage means from the unused rotor flanks to said crankcase region.

6. The device according to claim 5 further comprising further passage means directly connecting the unused flanks.

* * * * *